US006959471B2

(12) United States Patent
Temple et al.

(10) Patent No.: US 6,959,471 B2
(45) Date of Patent: Nov. 1, 2005

(54) METHOD OF MANUFACTURING A DROPLET DEPOSITION APPARATUS

(75) Inventors: Stephen Temple, Cambridge (GB); Robert A. Harvey, Cambridge (GB); Mark R. Shepherd, Herts (GB); Paul R. Drury, Herts (GB); Angus Condie, Cambridge (GB); Salhadin Omer, Cambridge (GB)

(73) Assignee: Xaar Technology Limited, Cambridge (GB)

( * ) Notice: Subject to any disclaimer, the term of this patent is extended or adjusted under 35 U.S.C. 154(b) by 0 days.

(21) Appl. No.: 09/853,520

(22) Filed: May 11, 2001

(65) Prior Publication Data

US 2002/0008741 A1 Jan. 24, 2002

Related U.S. Application Data

(63) Continuation of application No. PCT/GB99/03799, filed on Nov. 15, 1999.

(30) Foreign Application Priority Data

Nov. 14, 1998 (GB) ..... 9824998
Aug. 14, 1999 (GB) ..... 9919201

(51) Int. Cl.[7] ..... H04R 17/00; B05D 5/12
(52) U.S. Cl. ..... 29/25.35; 29/890.1; 29/846; 29/DIG. 1; 29/DIG. 16; 219/121.67; 219/121.68; 347/68; 427/96.1; 427/97.7; 427/98.4
(58) Field of Search ..... 29/25.35, 890.1, 29/846, 847, 852, DIG. 1, DIG. 16; 219/121.67, 121.68; 347/68, 71, 72; 427/96.1, 97.7, 98.4, 100, 123

(56) References Cited

U.S. PATENT DOCUMENTS

| | | | | |
|---|---|---|---|---|
| 5,193,256 A | | 3/1993 | Ochiai et al. | 29/25.35 |
| 5,248,998 A | | 9/1993 | Ochiai et al. | 347/71 |
| 5,347,712 A | * | 9/1994 | Yasuda et al. | 29/852 |
| 5,767,878 A | | 6/1998 | Murphy | 347/71 |
| 5,787,558 A | | 8/1998 | Murphy | 29/25.35 |
| 5,889,539 A | | 3/1999 | Kamoi et al. | 347/50 |

FOREIGN PATENT DOCUMENTS

| | | |
|---|---|---|
| EP | 0 277 703 A1 | 8/1988 |
| EP | 0 326 973 A2 | 8/1989 |
| EP | 0 364 136 A2 | 4/1990 |

(Continued)

OTHER PUBLICATIONS

Berchtold, A., "Simulation of a Drop–On–Demand Print Head with Planar Piezoelectric Transducer", VLSI and Computer Peripherals, VLSI and Microelectronic Applications in Intelligent Peripheras and their Interconnection Networks', May 1989, pp. 53–55.*

(Continued)

*Primary Examiner*—A. Dexter Tugbang
(74) *Attorney, Agent, or Firm*—Marshall, Gerstein & Borun LLP

(57) ABSTRACT

A method of manufacturing an ink jet print head includes the steps of bonding a body of piezoelectric material to a base plate and cutting channels into the piezoelectric material to form ink chambers which are actuated by applying voltages to electrodes provided on surfaces of the chambers. The base plate carries IC's which contain the drive circuitry for actuating the ink chambers. To ensure reliable electrical connection between the chamber electrodes and the IC's, the electrodes and conducting tracks on the base plate are formed in a single step by depositing a conductive layer over both the PZT body and the base plate. A step of masking or selective removal of material may be performed to achieve the necessary patterning of the electrodes and tracks.

19 Claims, 16 Drawing Sheets

FOREIGN PATENT DOCUMENTS

| | | | | | |
|---|---|---|---|---|---|
| EP | 0 376 606 | A1 | | 7/1990 | |
| EP | 0 397 441 | A2 | | 11/1990 | |
| EP | 0 505 065 | A2 | | 9/1992 | |
| EP | 0 522 814 | A2 | | 1/1993 | |
| EP | 0 704 305 | A2 | | 4/1996 | |
| EP | 0 755 792 | A2 | | 1/1997 | |
| EP | 0 839 656 | A1 | | 5/1998 | |
| JP | 5-64893 | | | 3/1993 | |
| JP | 5-147215 | | * | 6/1993 | ..... 29/25.35 |
| JP | 9-10983 | | | 1/1997 | |
| JP | 3292 146 | | | 3/2002 | |
| WO | WO 91/17051 | | | 11/1991 | |
| WO | WO 92/09436 | | | 6/1992 | |
| WO | WO 92/22429 | | | 12/1992 | |
| WO | WO 93/15911 | | | 8/1993 | |
| WO | WO 95/04658 | | | 2/1995 | |
| WO | WO 98/17477 | | | 4/1998 | |
| WO | WO 98/52763 | | | 11/1998 | |

OTHER PUBLICATIONS

International Search Report in PCT/GB99/03799 dated Mar. 10, 2000.

International Preliminary Examination Report in PCT/GB99/03799 dated Feb. 16, 2001.

* cited by examiner

*Prior Art*

Prior Art

13'
190"
195
13
86
190'
192"
192'

METHOD OF MANUFACTURING A DROPLET DEPOSITION APPARATUS

RELATED APPLICATION DATA

This is a continuation of International Application No. PCT/GB99/03799 filed Nov. 15, 1999, the entire disclosure of which is incorporated herein by reference.

FIELD OF THE INVENTION

The present invention relates to droplet deposition apparatus, particularly inkjet printheads, components thereof and methods for manufacturing such components.

BACKGROUND OF THE INVENTION

A particularly useful form of inkjet printer comprises a body of piezoelectric material with ink channels formed, for example, by disc cutting. Electrodes can be plated on the channel-facing surfaces of the piezoelectric material, enabling an electrical field to be applied to the piezoelectric "wall" defined between adjacent channels. With appropriate poling, this wall can be caused to move into or out of the selected ink channel, causing a pressure pulse which ejects an ink droplet through an appropriate channel nozzle. Such a construction is shown, for example, in EP-A-0 364 136.

It is a frequent requirement to provide a high density of such ink channels, with precise registration across a relatively large expanse of printhead, perhaps an entire page width. A construction that is useful to this end is disclosed in WO 98/52763. It involves the use of a flat base plate that supports the piezoelectric material as well as integrated circuits performing the necessary processing and control functions.

Such a construction has several advantages, particularly with regard to manufacture. The base plate acts as a "backbone" for the printhead, supporting the piezoelectric material and integrated circuits during manufacture. This support function is particularly important during the process of butting together multiple sheets of piezoelectric material to form a contiguous, pagewide array of ink channels. The relatively large size of the base plate also simplifies handling.

A problem remains of reliably and efficiently establishing electrical connection between the ink channel electrodes and the corresponding pins of the integrated circuits. If the base plate is of suitable material and suitably finished, conductive tracks can be deposited on it, these tracks connecting in known manner with the IC pins. There remains the difficulty of establishing connections to channel electrodes.

SUMMARY OF THE INVENTION

The present invention seeks to provide improved apparatus and methods which address this problem.

Accordingly, the present invention consists in one aspect in a method of manufacturing a component of a droplet deposition apparatus, the component comprising a body of piezoelectric material having a plurality of channels each with a channel surface and a base, the body being attached to a surface of the base which is free of substantial discontinuities; the method comprising the steps of attaching the body to said surface of the base; and depositing a layer of conductive material so as to extend continuously over at least one of said channel surfaces and said surface of the base to provide an electrode on each channel surface and a conductive track on said surface of the base which is integrally connected to the electrode.

The attachment of the body to a surface of the base and subsequent deposition of a continuous layer of conductive material over said at least one channel surface and the base surface results in an effective and reliable electrical connection between channel wall electrodes and substrate conductive tracks. Those tracks can be used to provide connection with one or more integrated circuits carried on the base, either directly or through other tracks and interconnections.

The present invention also consists in a component for a droplet deposition apparatus comprising a body of piezoelectric material formed with a plurality of channels each channel having a channel surface; and a separate base having a base surface free of substantial discontinuities; wherein the body is attached to said base surface and a layer of conductive material extends continuously over said channel surfaces of and said base surface, thereby defining an electrode on each channel surface and a conductive track connected thereto on the base surface.

BRIEF DESCRIPTION OF THE DRAWINGS

The invention will now be described by way of example with reference to the accompanying drawings, in which.

DETAILED DESCRIPTION OF THE PREFERRED EMBODIMENTS

It will be helpful to describe first in some detail, examples of the prior art constructions referred to briefly above.

Figure 1:
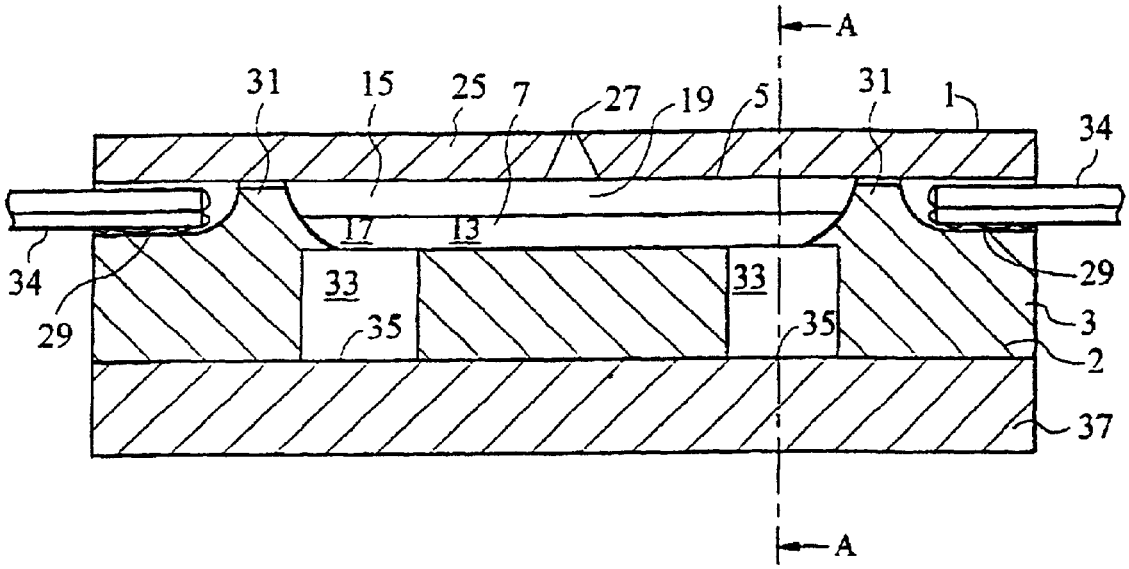
Prior Art Fig. 1
FIG. 1 is a longitudinal sectional view through a known ink jet printhead.

Thus, FIG. 1 shows a prior art inkjet printhead 1 of the kind disclosed in WO 91/17051 and comprising a sheet 3 of piezoelectric material, for example lead zirconium titanate (PZT), formed in a top surface thereof with an array of open-topped ink channels 7. As evident from FIG. 2, which is a sectional view taken along line AA of FIG. 1, successive channels in the array are separated by side walls 13 which comprise piezoelectric material poled in the thickness direction of the sheet 3 (as indicated by arrow P). On opposite channel-facing surfaces 17 are arranged electrodes 15 to which voltages can be applied via connections 34. As is known, e.g. from EP-A-0 364 136, application of an electric field between the electrodes on either side of a wall results in shear mode deflection of the wall into one of the flanking channels—this is shown exaggerated by dashed lines in FIG. 2—which in turn generates a pressure pulse in that channel.

Figure 2:
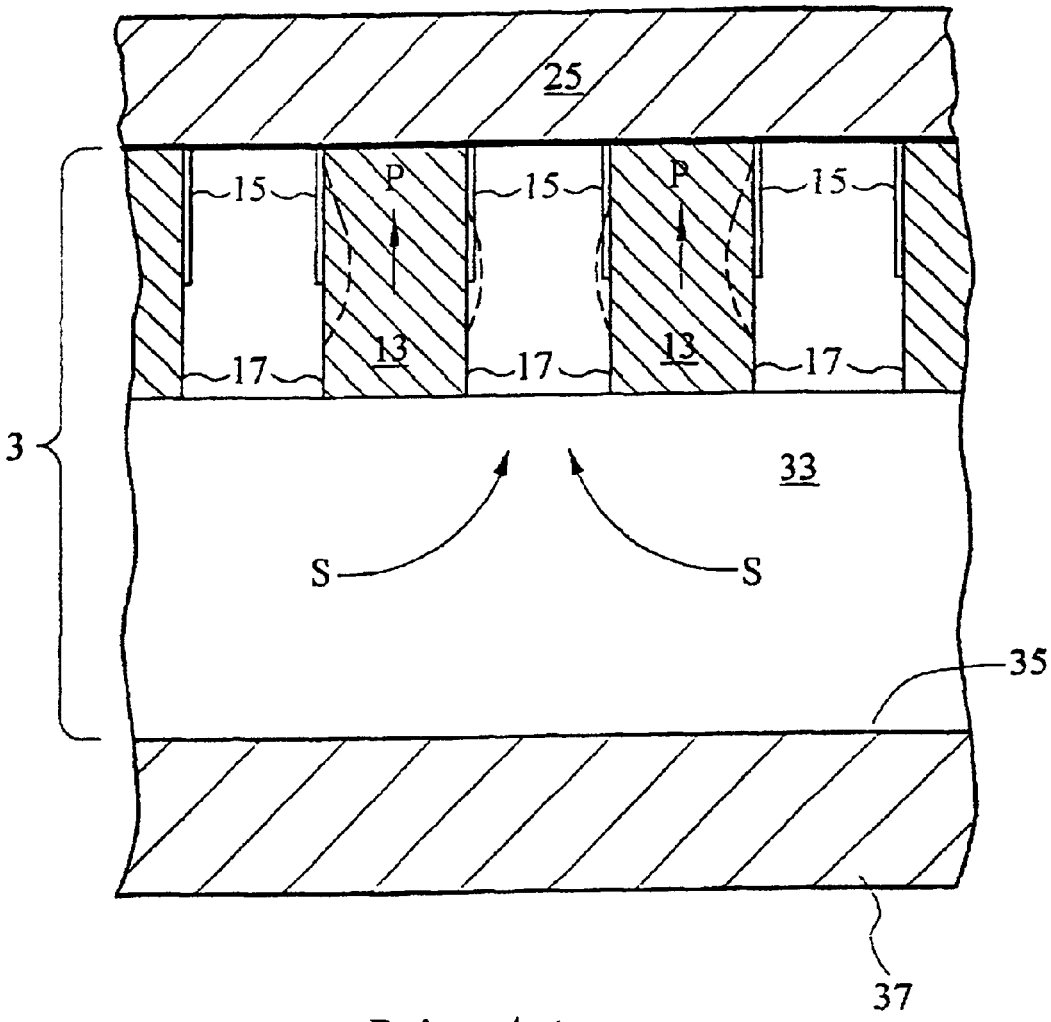
FIG. 2 is a transverse sectional view on line AA of FIG. 1

The channels are closed by a cover 25 in which are formed nozzles 27 each communicating with respective channels at the mid-points thereof. Droplet ejection from the nozzles takes place in response to the aforementioned pressure pulse, as is well known in the art. Supply of droplet fluid into the channels, indicated by arrows S in FIG. 2, is via two ducts 33 cut into the bottom face 35 of sheet 3 to a depth such that they communicate with opposite ends respectively of the channels 7. Such a channel construction may consequently be described a double-ended side-shooter arrangement. A cover plate 37 is bonded to the bottom face 35 to close the ducts.

Figure 3:
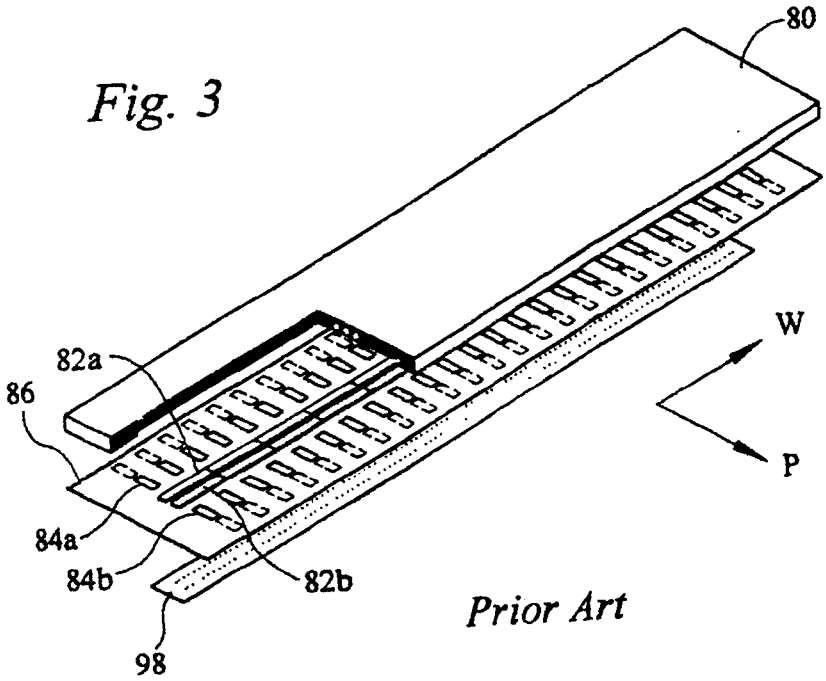
FIG. 3 is an exploded view of a page wide printhead array according to the prior art.
Figure 4:
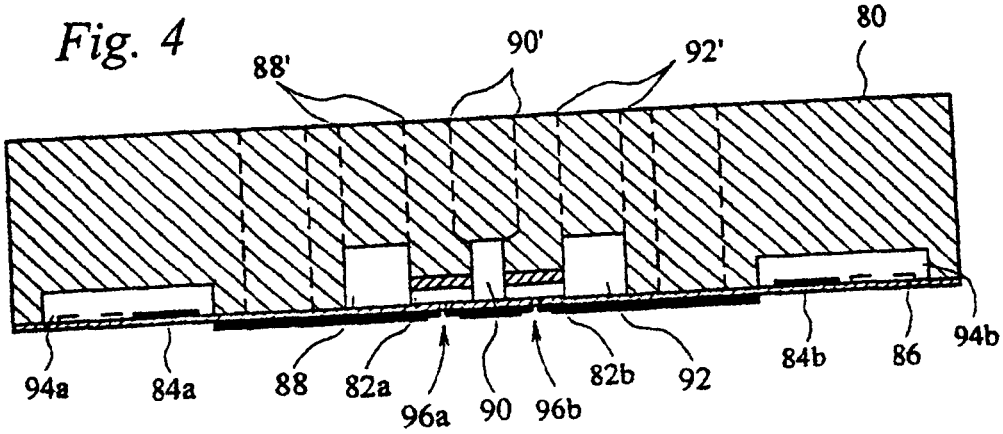
Prior Art Fig. 4
FIG. 4 is an assembled longitudinal sectional view through the printhead shown in FIG. 3.

FIGS. 3 and 4 are exploded perspective and sectional views respectively of a printhead employing the double-ended side-shooter concept of FIGS. 1 and 2 in a "pagewide" configuration. Such a printhead is described in WO 98/52763, incorporated herein by reference. Two rows of channels spaced relatively to one another in the media feed direction are used, with each row extending the width of a page in a direction 'W' transverse to a media feed direction P. Features common with the embodiment of FIGS. 1 and 2 are indicated by the same reference Figures used in FIGS. 1 and 2.

As shown in FIG. 4, which is a sectional view taken perpendicular to the direction W, two piezoelectric sheets 82*a*, 82*b* each having channels (formed in their bottom surface rather than their top as in the previous example) and electrodes as described above are closed (again on their bottom surface rather than their top) by a flat, extended base 86 in which openings 96*a*, 96*b* for droplet ejection are formed. Base 86 is also formed with conductive tracks (not shown) which are electrically connected to respective channel electrodes, e.g. by solder bonds as described in WO 92/22429, and which extend to the edge of the base where respective drive circuitry (integrated circuits 84*a*, 84*b*) for each row of channels is located.

Such a construction has several advantages, particularly with regard to manufacture. Firstly, the extended base 86 acts as a "backbone" for the printhead, supporting the piezoelectric sheets 82*a*, 82*b* and integrated circuits 84*a*, 84*b* during manufacture. This support function is particularly important during the process of butting together multiple sheets 3 to form a single, contiguous, pagewide array of channels, as indicated at 82*a* and 82*b* in the perspective view of FIG. 3. One approach to butting is described in WO 91/17051 and consequently not in any further detail here. The size of the extended cover also simplifies handling.

Another advantage arises from the fact that the surface of the base on which the conductive tracks are required to be formed is flat, i.e. it is free of any substantial discontinues. As such, it allows many of the manufacturing steps to be carried out using proven techniques used elsewhere in the electronics industry, e.g. photolithographic patterning for the conductive tracks and "flip chip" for the integrated circuits. Photolithographic patterning in particular is unsuitable where a surface undergoes rapid changes in angle due to problems associated with the spinning method typically used to apply photolithographic films. Flat substrates also have advantages from the point of view of ease of processing, measuring, accuracy and availability.

A prime consideration when choosing the material for the base is, therefore, whether it can easily be manufactured into a form where it has a surface free of substantial discontinuities. A second requirement is for the material to have thermal expansion characteristics to the piezoelectric material used elsewhere in the printhead. A final requirement is that the material be sufficiently robust to withstand the various manufacturing processes. Aluminium nitride, alumina, INVAR or special glass AF45 are all suitable candidate materials.

The droplet ejection openings 96*a*, 96*b* may themselves be formed with a taper, as per the embodiment of FIG. 1, or the tapered shape may be formed in a nozzle plate 98 mounted over the opening. Such a nozzle plate may comprise any of the readily-ablatable materials such as polyimide, polycarbonate and polyester that are conventionally used for this purpose. Furthermore, nozzle manufacture can take place independently of the state of completeness of the rest of the printhead: the nozzle may be formed by ablation from the rear prior to assembly of the active body 82*a* onto the base or substrate 86 or from the front once the active body is in place. Both techniques are known in the art. The former method has the advantage that the nozzle plate can be replaced or the entire assembly rejected at an early stage in assembly, minimising the value of rejected components. The latter method facilitates the registration of the nozzles with the channels of the body when assembled on the substrate.

Following the mounting of piezoelectric sheets 82*a*, 82*b* and drive chips 84*a*, 84*b* onto the substrate 86 and suitable testing as described, for example, in EP-A-0 376 606—a body 80 can be attached. This too has several functions, the most important of which is to define, in cooperation with the base or substrate 86, manifold chambers 90,88 and 92 between and to either side of the two channel rows 82*a*, 82*b* respectively. Body 80 is further formed with respective conduits as indicated at 90', 88' and 92' through which ink is supplied from the outside of the printhead to each chamber. It will be evident that this results in a particularly compact construction in which ink can be circulated from common manifold 90, through the channels in each of the bodies (for example to remove trapped dirt or air bubbles) and out through chambers 88 and 92. Body 80 also provides surfaces for attachment of means for locating the completed printhead in a printer and defines further chambers 94*a*, 94*b*, sealed from ink-containing chambers 88,90,92 and in which integrated circuits 84*a*, 84*b* can be located.

Figure 5:
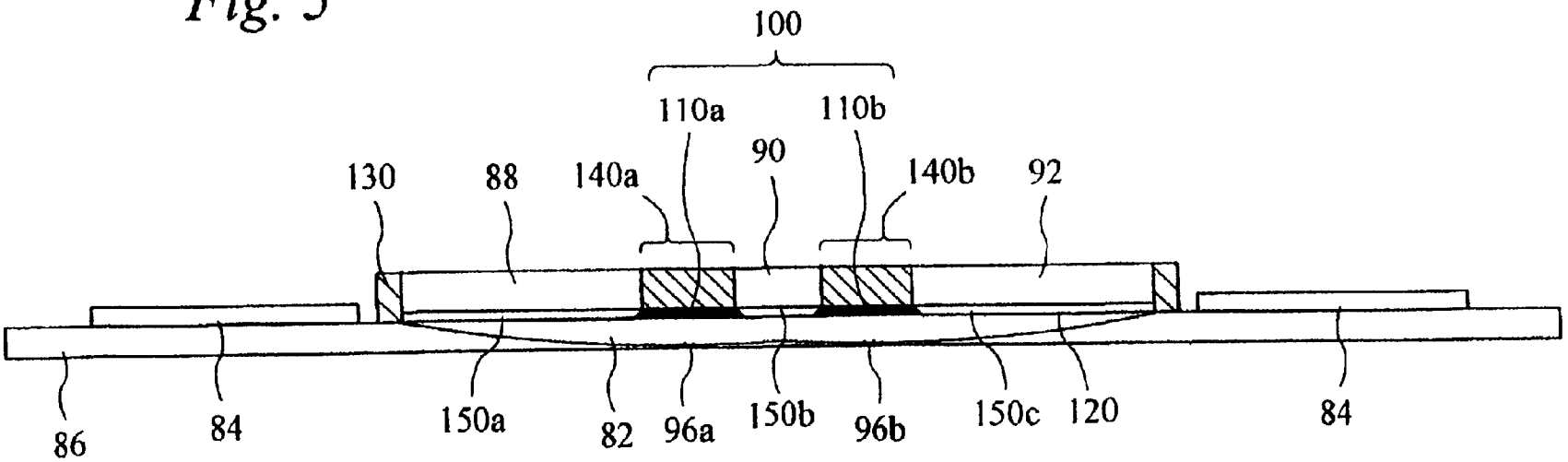
FIG. 5 is an assembled sectional view, similar to that of FIG. 4, of a printhead according to a first embodiment of the invention.

Turning now to an example of the present invention, reference is made to FIG. 5. This is a sectional view similar to that of FIG. 4, illustrating a printhead in accordance with the present invention. Wherever features are common with the embodiments of FIGS. 1–4, the same reference figures as used in FIGS. 1–4 have been used.

As with the previous embodiments, the printhead of FIG. 5 comprises a "pagewide" base plate or substrate 86 on which two rows of integrated circuits 84 are mounted. In-between lies a row of channels 82 formed in the substrate 84, each channel of which communicates with two spaced nozzles 96*a*, 96*b* for droplet ejection and with manifolds 88, 92 and 90 arranged to either side and between nozzles 96*a*, 96*b* respectively for ink supply and circulation.

Figure 6A:
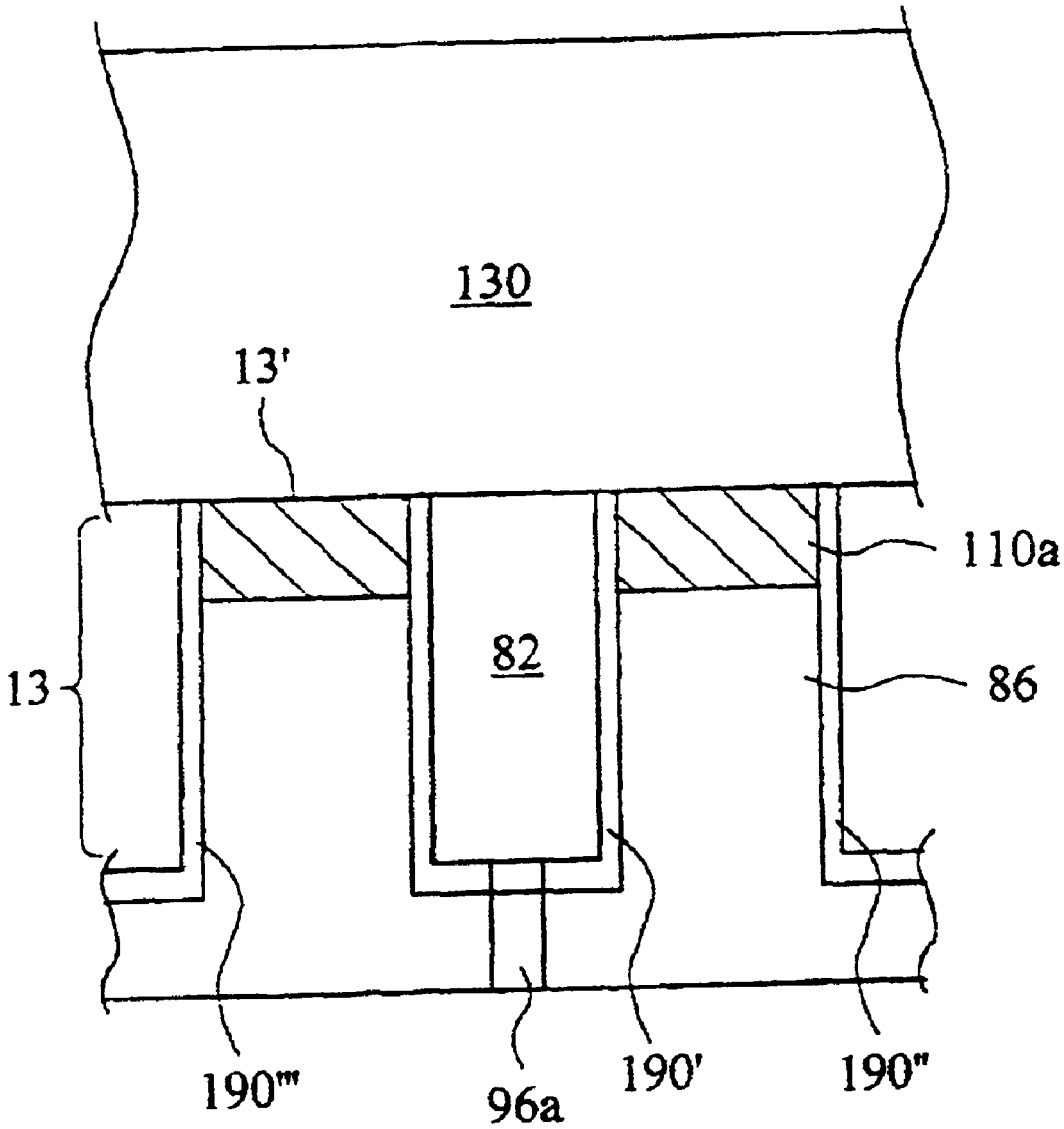
FIGS. 6(*a*) and 6(*b*) are detail sectional views taken perpendicular and parallel to the channel axis of the device of FIG. 5.
Figure 6B:
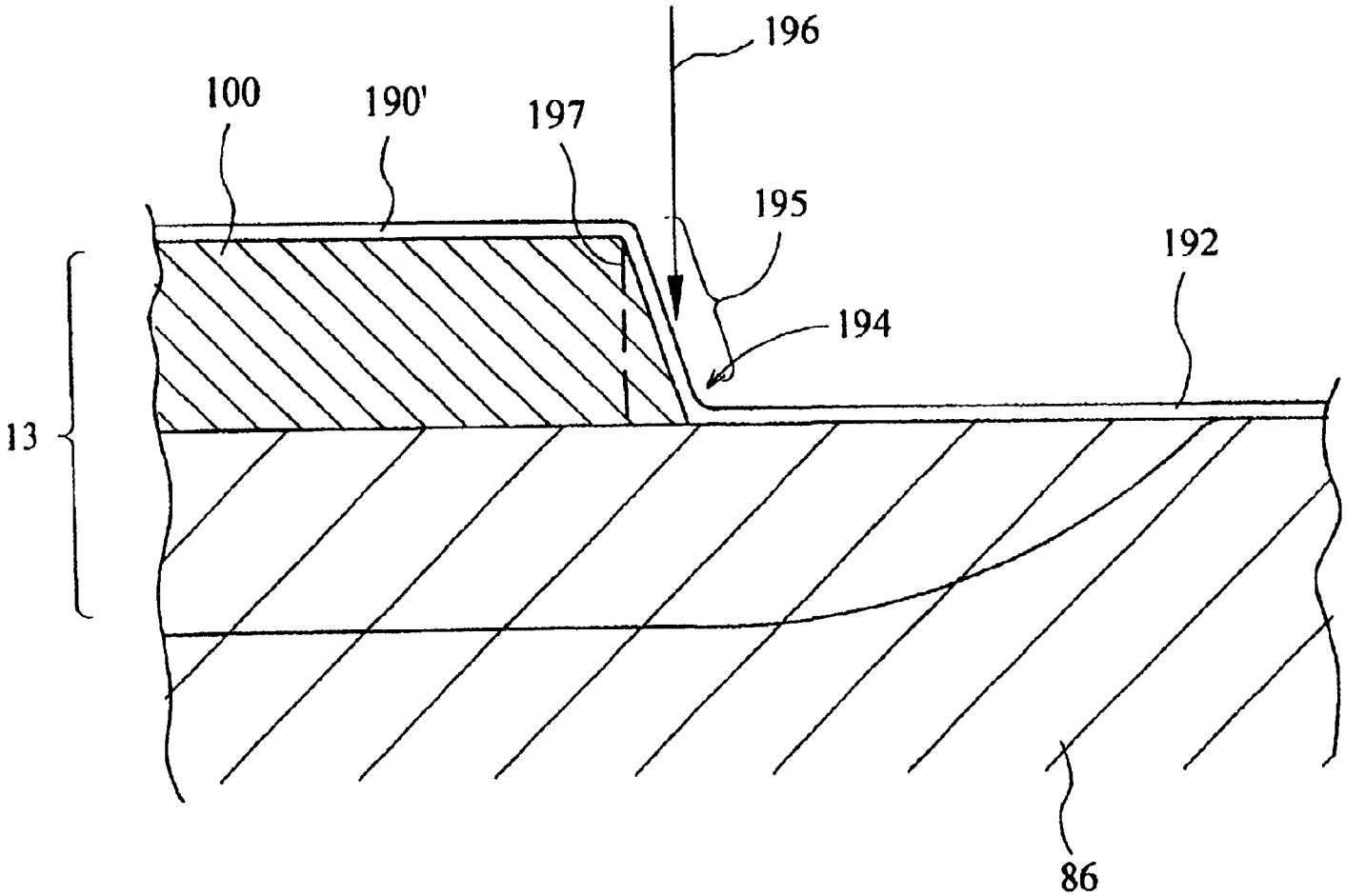

In contrast to the printhead embodiments discussed above, the piezoelectric material for the channel wails is incorporated in a layer 100 made up of two strips 110*a*,

110*b*. As in the embodiment of FIG. 4, these strips will be butted together in the page width direction W, each strip extending approximately 5–10 cm (this being the typical dimension of the wafer in which form such material is generally supplied). Prior to channel formation, each strip is bonded to the continuous planar surface 120 of the substrate 86, following which channels are sawn or otherwise formed so as to extend through both strip and substrate. A cross-section through a channel, its associated actuator walls and nozzle is shown in FIG. 6. Such an actuator wall construction is known, e.g. from EP-A-0 505 065 and consequently will not be discussed in any greater detail. Similarly, appropriate techniques for removing both the glue bonds between adjacent butted strips of piezoelectric material and the glue relief channels used in the bond between each piezoelectric strip and the substrate are known from US 5,193,256 and WO 95/04658 respectively.

In accordance with the present invention, a continuous layer of conductive material is then applied over the channel walls and substrate. Not only does this form electrodes 190 for application of electric fields to the piezoelectric walls 13—as illustrated in FIG. 6(*a*)—and conductive tracks 192 on substrate 86 for supply of voltages to those electrodes as shown in FIG. 6(*b*)—it also forms an electrical connection between these two elements as shown at 194.

Appropriate electrode materials and deposition methods are well-known in the art. Copper, Nickel and Gold, used alone or in combination and deposited advantageously by electroless processes utilising palladium catalyst will provide the necessary integrity, adhesion to the piezoelectric material, resistance to corrosion and basis for subsequent passivation e.g. using Silicon Nitride as known in the art.

As is generally known, e.g. from the aforementioned EP-A-0 364 136, the electrodes on opposite sides of each actuator wall 13 must be electrically isolated from one another in order that an electric field may be established between them and hence across the piezoelectric material of the actuator wall. This is shown in both the prior art arrangement of FIG. 2 and the embodiment of the present invention shown in FIG. 6(*a*). The corresponding conductive tracks connecting each electrode with a respective voltage source must be similarly isolated.

In the present invention, such isolation may be achieved at the time of deposition for example by masking those areas—such as the tops of the channel walls—where conductive material is not required. Suitable masking techniques, including patterned screens and photolithographically patterned masking materials are well-known in the art, e.g. from WO 98/17477 and EP-A-0 397 441, and will not be described in any further detail.

Figure 7:
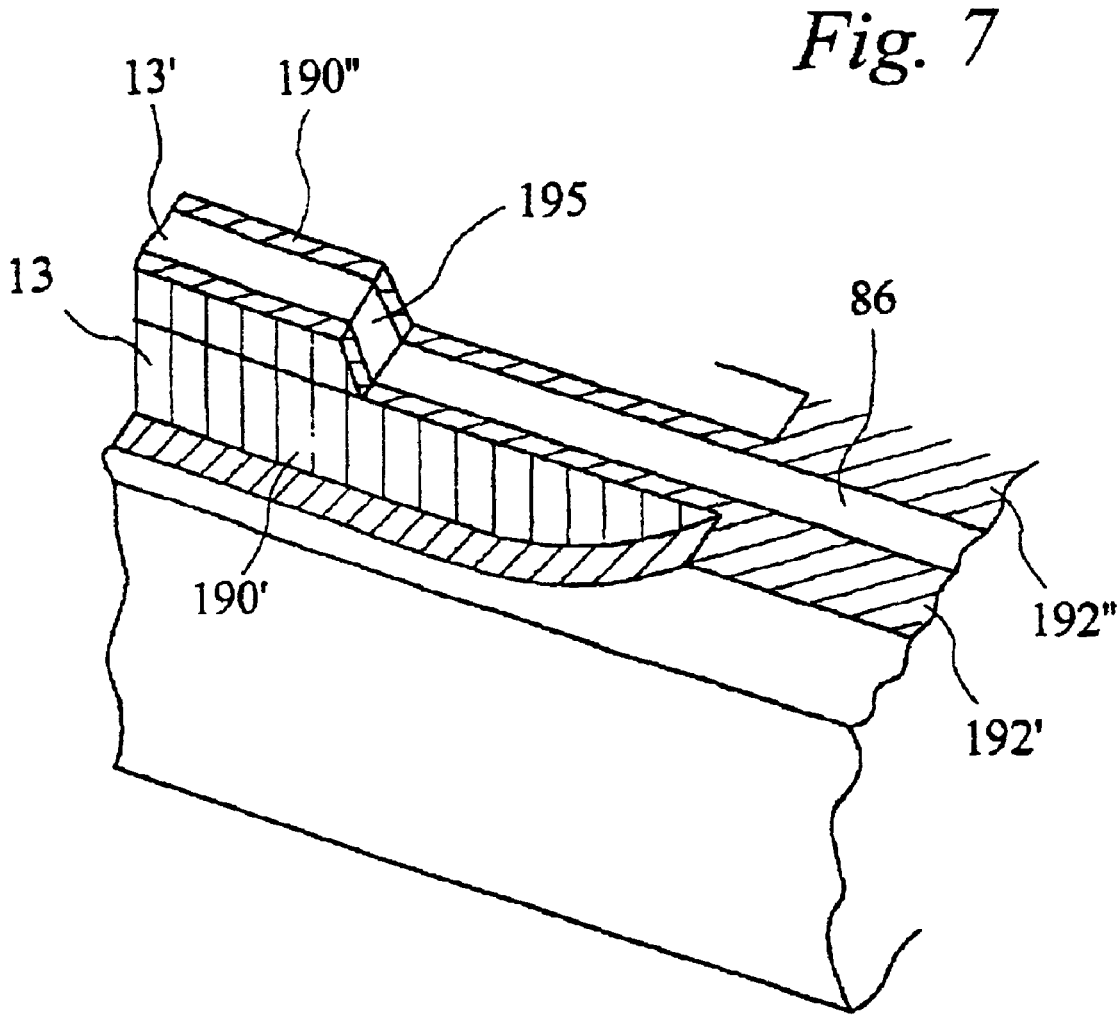
FIG. 7 is a detail perspective view of the device of FIG. 5.

Alternatively, isolation may be achieved after deposition by removing conductive material from those areas where it is not required. Localised vaporisation of material by laser beam, as known e.g. from JP-A-09 010 983, has proved most suitable for achieving the high accuracy required, although other conventional removal methods—inter alia sand blasting, etching, electropolishing and wire erosion may also be suitable. FIG. 7 illustrates material removal, in this case over a narrow band running along the top of the wall, although several passes of the laser beam (or a single pass of a wider laser beam) can be used to remove material from the entire top surface of the wall so as to maximise the wall top area available for bonding with the cover member 130.

In addition to removing conductive material from the top surface 13' of each piezoelectric actuator wall 13 so as to separate the electrodes 190', 190", on either side of each wall, conductive material must also be removed from the surface of the substrate 86 in such a way as to define respective conductive tracks 192', 192" for each electrode 190' 190". At the transition between piezoelectric material 100 and substrate 86, the end surface of the piezoelectric material 100 is angled or chamfered as shown at 195. As is known, this has the advantage over a perpendicular cut (of the kind indicated by a dashed line at 197) of allowing the vapourising laser beam—shown figuratively by arrow 196—to impinge on and thereby remove the conductive material without requiring angling of the beam. Preferably, the chamfer 195 is formed by milling after the piezoelectric layer 100 has been attached to the substrate 86 but before the formation of the channel walls which, being typically 300 μm thick and formed of ceramic and glass, are vulnerable to damage. A chamfer angle of 45 degrees has been found to be suitable.

It will also be appreciated that the electrodes and conductive tracks associated with the active portions 140*a* need to be isolated from those associated with 140*b* in order that the rows of nozzles might be operated independently. Although this too may be achieved by a laser "cut" along the surface of the substrate 86 extending between the two piezoelectric strips, it is more simply achieved by the use of a physical mask during the electrode deposition process or by the use of electric discharge machining.

Laser machining can also be used in a subsequent step to form the ink ejection holes 96*a*, 96*b* in the base of each channel, as is known in the art. Such holes may directly serve as ink ejection nozzles. Alternatively, there may be bonded to the lower surface of the substrate 86 a separate plate (not shown) having nozzles that communicate with the holes 96*a*, 96*b* and which are of a higher quality that might otherwise be possible with nozzles formed directly in the ceramic or glass base of the channel. Appropriate techniques are well-known, particularly from WO 93/15911 which discloses a technique for the formation of nozzles in situ, after attachment of the nozzle plate, thereby simplifying registration of each nozzle with its respective channel.

The conductive tracks 192', 192" defined by laser may extend all the way from the transition area 195 to the integrated circuits 84 located at either side of the substrate. Alternatively, the laser track definition process may be restricted to an area directly adjacent the piezoelectric material and a different—e.g. photolithographic—process used to define further conductive tracks that connect the laser-defined tracks with the integrated circuits 84.

Having established tile electrical connections, it remains only to adhesively bond (e.g. using an offset method) a cover member 130 to the surface of substrate 86. This cover fulfils several functions: firstly, it closes each channel along those portions 140*a*, 140*b* where the walls incorporate piezoelectric material in order that actuation of the material and the resulting deflection of the walls might generate a pressure pulse in the channel portions and cause ejection of a droplet through a respective opening. Secondly, the cover and substrate define between them ducts 150*a*, 150*b* and 150*c* which extend along either side of each row of active channel portions 140*a*, 140*b* and through which ink is supplied. The cover is also formed with ports 88, 90, 92 which connect ducts 150*a*, 150*b* and 150*c* with respective parts of an ink system. In addition to replenishing the ink that has been ejected, such a system may also circulate ink through the channels (as indicated by arrows 112) for heat, dirt and bubble removing purposes as is known in the art. A final function of the cover is to seal the ink-containing part of the printhead from the outside world and particularly the electronics 84. This has been found to be satisfactorily achieved by the adhesive bond between the substrate 86 and cover rib 132, although additional measures such as glue fillets could be employed. Alternatively, cover rib may be replaced by an appropriately shaped gasket member.

Broadly expressed, the printhead of FIG. 5 includes a first layer having a continuous planar surface; a second layer of piezoelectric material bonded to said continuous planar surface; at least one channel that extends through the bonded first and second layers; the second layer having first and second portions spaced along the length of the channel; and a third layer that serves to close on all sides lying parallel to the axis of the channel portions of the channel defined by said first and second portions of said second layer.

It will be appreciated that restricting the use of piezoelectric material to those "active" portions of the channel where it is required to displace the channel walls is an efficient way, of utilising what is a relatively expensive material. The capacitance associated with the piezoelectric material is also minimised, reducing the load on—and thus the cost of—the driving circuitry.

Figure 8:
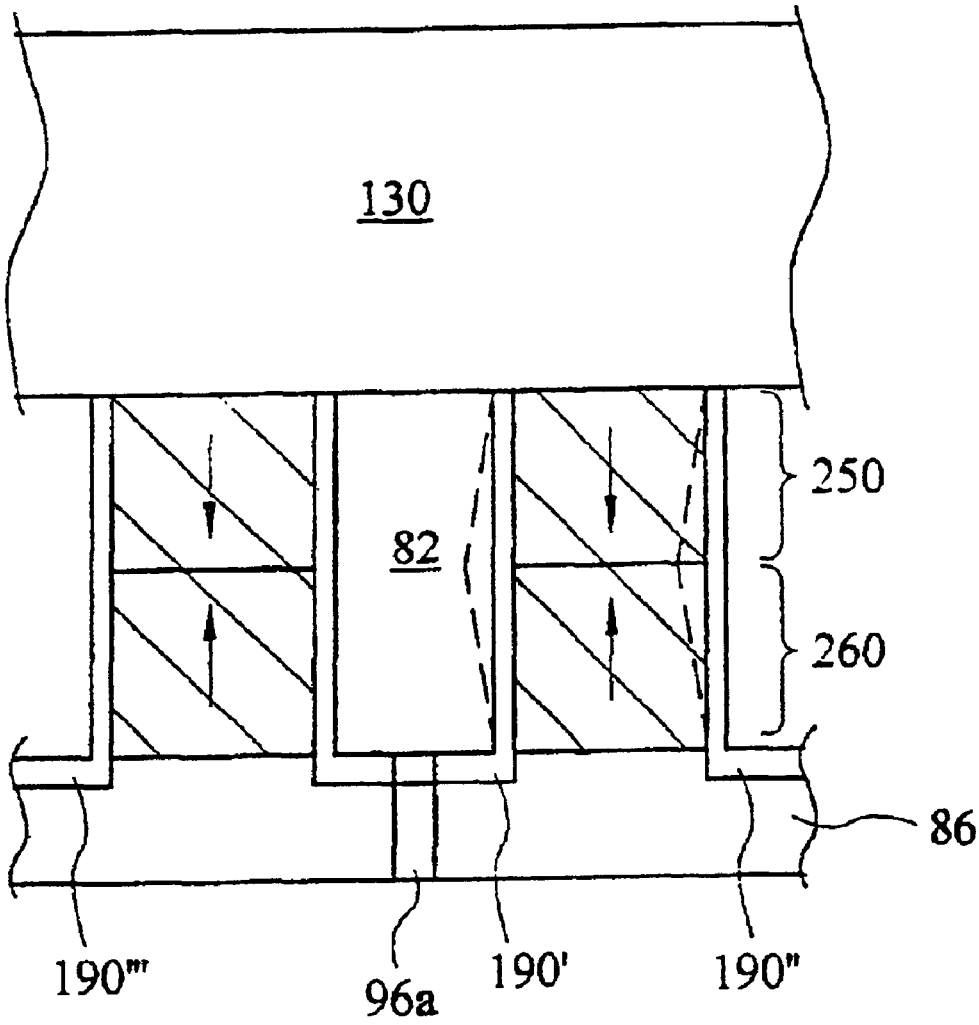
FIG. 8 is a cross-sectional view through a channel of a printhead according to a second embodiment of the invention.
Figure 9:
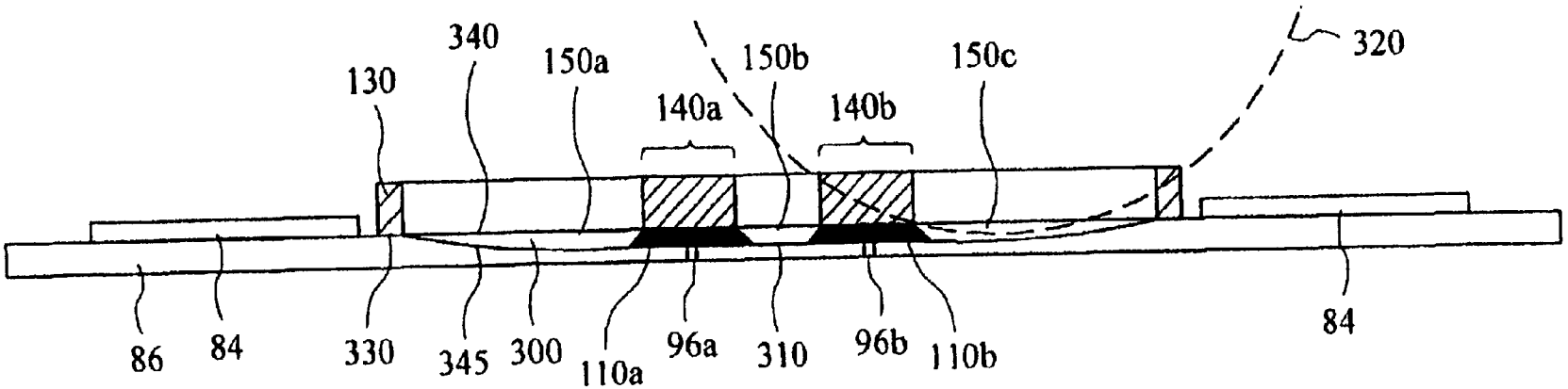
FIGS. 9–11 are a sectional views along the channel of third, fourth and fifth embodiments of the invention respectively.

Whereas the printhead of FIGS. 5 and 6 employs actuator walls of the "cantilever" type in which only part of the wall distorts in response to the application of an actuating electric field, the actuator walls of the printhead of FIGS. 8 and 9 actively distort over their entire height into a chevron shape. As is well-known and illustrated in FIG. 8, such a "chevron" actuator has upper and lower wall parts 250,260 poled in opposite directions (as indicated by arrows) and electrodes 190', 190" on opposite surfaces for applying a unidirectional electric field over the entire height of the wall. The approximate distorted shape of the wail when subjected to electric fields is shown exaggerated in dashed lines 270 on the right-hand side of FIG. 8.

Various methods of manufacturing such "chevron" actuator walls are known in the art, e.g. from EP-A-0 277 703, EP-A-0 326 973 and WO 92/09436. For the printhead of FIGS. 9 and 10, two sheets of piezoelectric material are first arranged such that their directions of polarisation face one another. The sheets are then laminated together, cut into strips and finally bonded to an inactive substrate 86, as already explained with regard to FIG. 5.

One consequence of the entire actuator wall height being defined by piezoelectric material is that there is no need to saw wall-defining grooves into the inactive substrate 86. There remains, of course, the need for the length of the nozzles 96*a*, 96*b* to be kept to a minimum so as to minimise losses that would otherwise reduce the droplet ejection velocity. To this end, the substrate can be reduced in thickness either locally by means of a trench 300 as shown in FIG. 9 and formed advantageously by sawing, grinding or moulding—or overall per FIG. 10. Both arrangements need to provide free passage for a disc cutter (shown diagrammatically in dashed lines at 320) used to form the channels in the piezoelectric strips.

Following channel formation and in accordance with the present invention, conductive material is then deposited and electrodes/conductive tracks defined. In the examples shown, piezoelectric strips 110*a* and 110*b* are chamfered to facilitate laser patterning, as described above. Nozzle holes 96*a*, 96*b* are also formed at two points along each channel.

Finally a cover member 130 is bonded to the tops of the channel walls so as to create the closed, "active" channel lengths necessary for droplet ejection. In the printhead of FIG. 9, the cover member need only comprise a simple planar member formed with ink supply ports 88, 90, 92 since gaps 150*a*, 150*b*, 150*c* necessary for distributing the ink along the row of channels are defined between the lower surface 340 of that cover member 130 and the surface 345 of the trench 300. Sealing of the channels is achieved at 330 by the adhesive bond (not shown) between the lower surface 340 of the cover 130 and the upper surface of the substrate. Broadly expressed, the printhead of this third invention embodiment includes a first layer of inactive material; a second layer of piezoelectric material comprising first and second portions formed with channels and bonded to the first layer in a spaced relationship; a third layer that serves to close the channels on all sides lying parallel to their axes; and outlets formed in the first layer for ink ejection from said channels in said portions of the second layer.

Figure 10:
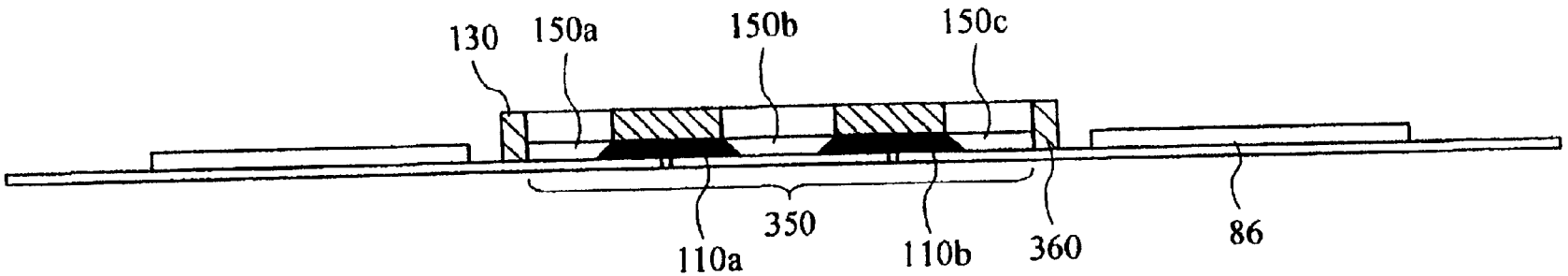

In the embodiment of FIG. 10, the simplicity of substrate 86 formed without trench 300 is offset by the need to form a trench-like structure 350 (defined, for example, by a projecting rib 360) in the cover 130 so as to define ink supply ducts 150*a*, 150*b*, 150*c*.

Figure 11:
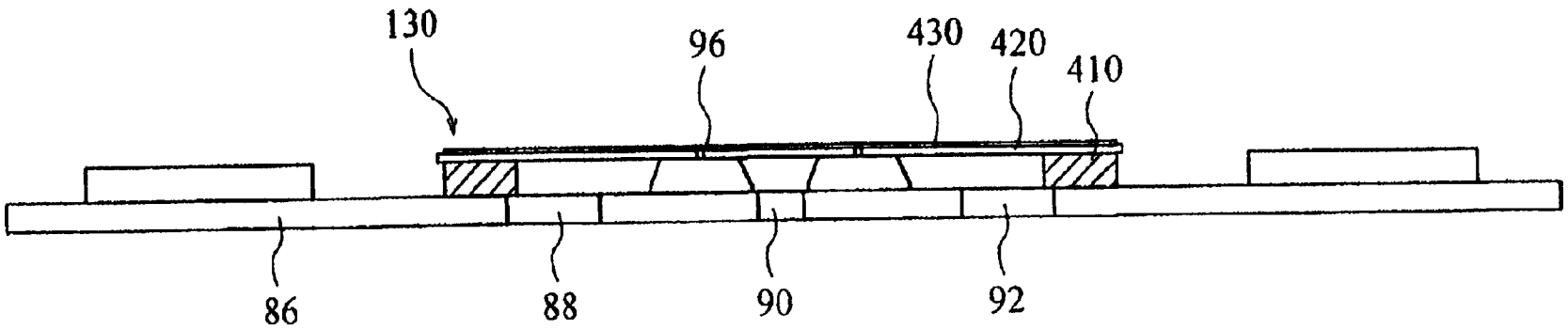

Turning to the embodiment of FIG. 11, this also employs the combination of a simple substrate 86 and a more-complex cover 130, in this case a composite structure made up of a spacer member 410 and a planar cover member 420. Unlike previous embodiments, however, it is the substrate 86 rather than the cover that is formed with ink supply ports 88, 90, 92 and the cover 130 rather than the substrate that is formed with holes 96 for droplet ejection. In the example shown, these holes communicate with nozzles formed in a nozzle plate 430 attached to the planar cover member 420.

Figure 12:
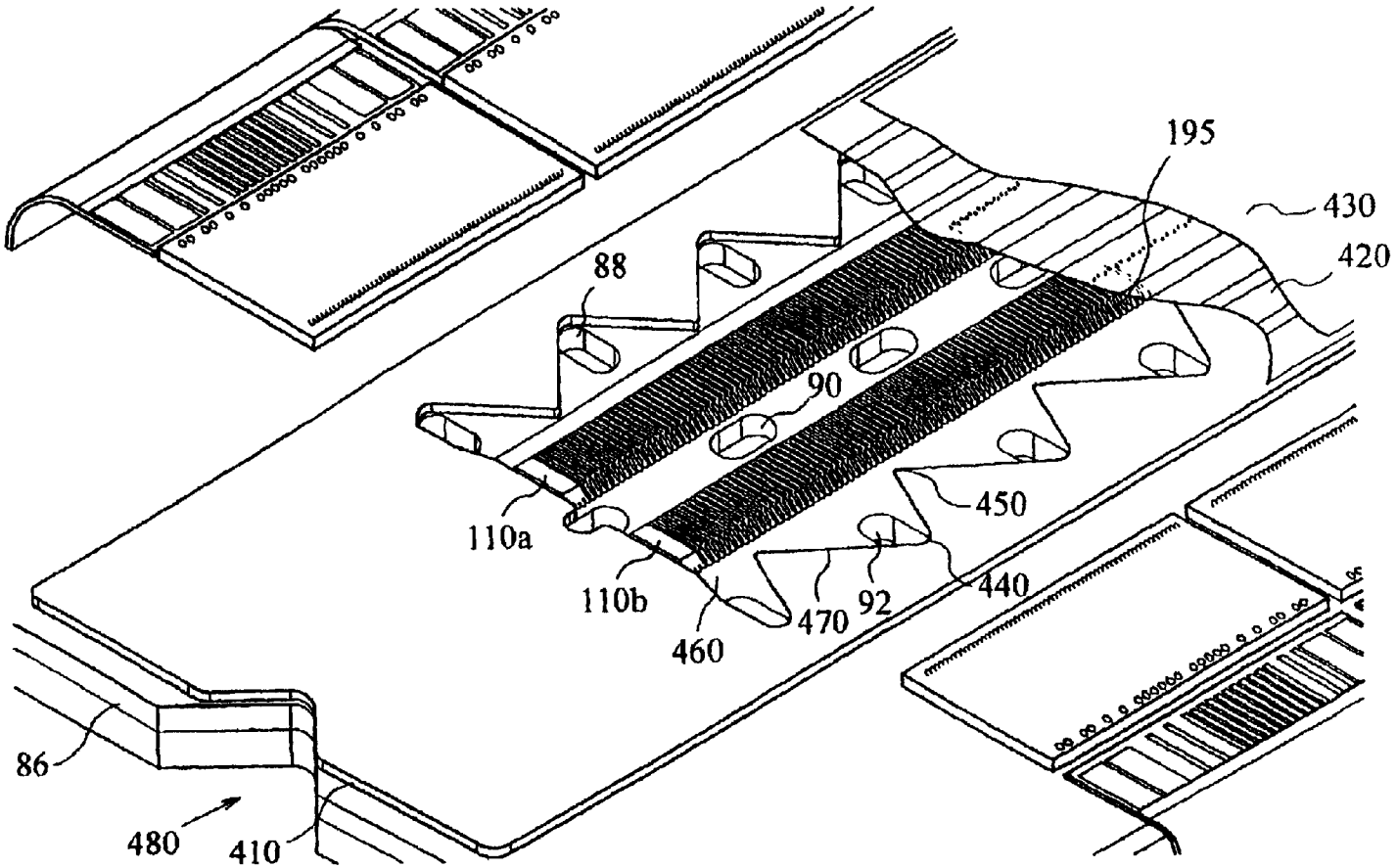
FIGS. 12 and 13 are perspective and detail perspective views respectively of the embodiment of FIG. 11.

FIG. 12 is a cut-away perspective view of the printhead of FIG. 11 seen from the cover side. The strips 110*a*, 110*b* of "chevron"-poled piezoelectric laminate have been bonded to substrate 86, and subsequently cut to form channels. A continuous layer of conductive material has then been deposited over the strips and parts of the substrate and electrodes and conductive tracks defined thereon in accordance with the present invention. As explained with regard to FIGS. 5 and 6, the strips are chamfered on either side (at 195) to aid laser patterning in this transition area.

Figure 13:
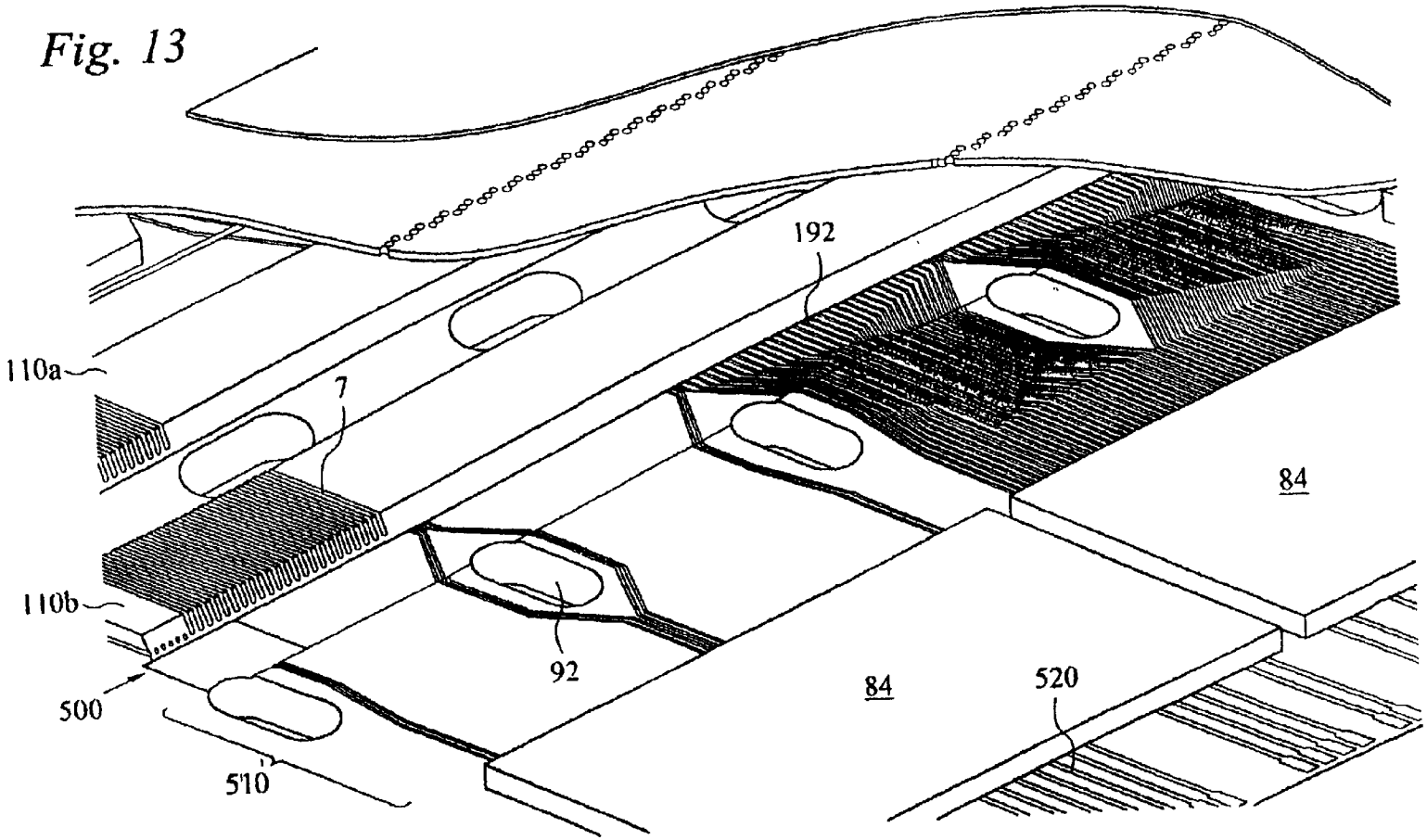

FIG. 13 is an enlarged view with spacer member 410 removed to show the conductive tracks 192 in more detail. Although not shown for reasons of clarity, it will be appreciated that these, like channels 7, extend across the entire width of the printhead. In the area of the substrate adjacent each strip (indicated by arrow 500 with regard to strip 110*b*) the tracks are continuous with the electrodes (not shown) on the facing walls of each channel, having been deposited in the same manufacturing step. This provides an effective electrical contact in accordance with the present invention.

However, elsewhere on the substrate—as indicated at 510—more conventional techniques, for example photolithographic, can be used to define not only tracks 192 leading from the channel electrodes to the integrated circuits 84 but also further tracks 520 for conveying power, data and other signals to the integrated circuits. Such techniques may be more cost effective, particularly where the conductive tracks are diverted around ink supply ports 92 and which would otherwise require complex positional control of a laser. They are preferably formed on the alumina substrate in advance of the ink supply ports 88, 90, 92 being drilled (e.g. by laser) and of the piezoelectric strips 110*a*, 110*b* being attached, chamfered and sawn. Following deposition of conductive material in the immediate area of the strips, a laser can then be used to ensure that each track is connected only with its respective channel electrode and no other.

Thereafter, both electrodes and tracks will require passivation, e.g. using Silicon Nitride deposited in accordance with WO 95/07820. Not only does this provide protection against corrosion due to the combined effects of electric fields and the ink (it will be appreciated that all conductive material contained within the area 420 defined by the inner profile 430 of spacer member 410 will be exposed to ink), it also prevents the electrodes on the opposite sides of each wall being short circuited by the planar cover member 430. Both cover and spacer are advantageously made of molybdenum which, in addition to having similar thermal expansion characteristics to the alumina used elsewhere in the printhead, can be easily machined, e.g. by etching, laser cutting or punching, to high accuracy. This is particularly important for the holes for droplet ejection 96 and, to a lesser extent, for the wavy, bubble-trap-avoiding, inner profile 430 of the spacer member 410. Bubble traps are further avoided by positioning the trough 440 of the wavy profile such that it aligns with or even overlies the edge of the respective ink port 92. Crest 450 of the wavy profile is similarly dimensioned (to lie a distance—typically 3 mm, approximately 1.5 times the width of each strip 110*a*, 110*b*—from the edge of the adjacent strip 110*a*, 110*b* to ensure avoidance of bubble traps without affecting the ink flow into the channels.

Spacer member 410 is subsequently secured to the upper surface of substrate 86 by a layer of adhesive. In addition to its primary, securing function, this layer also provides back-up electrical isolation between the conductive tracks on the substrate. Registration features such as notch 440 are used to ensure correct alignment.

The last two members to be adhesively attached—either separately or following assembly to one another—are the planar cover member 420 and nozzle plate 430. Optical means may be employed to ensure correct registration between the nozzles formed in the nozzle plate and the channels themselves. Alternatively, the nozzles can be formed once the nozzle plate is in situ as known, for example, from WO 93/15911.

Figure 14:
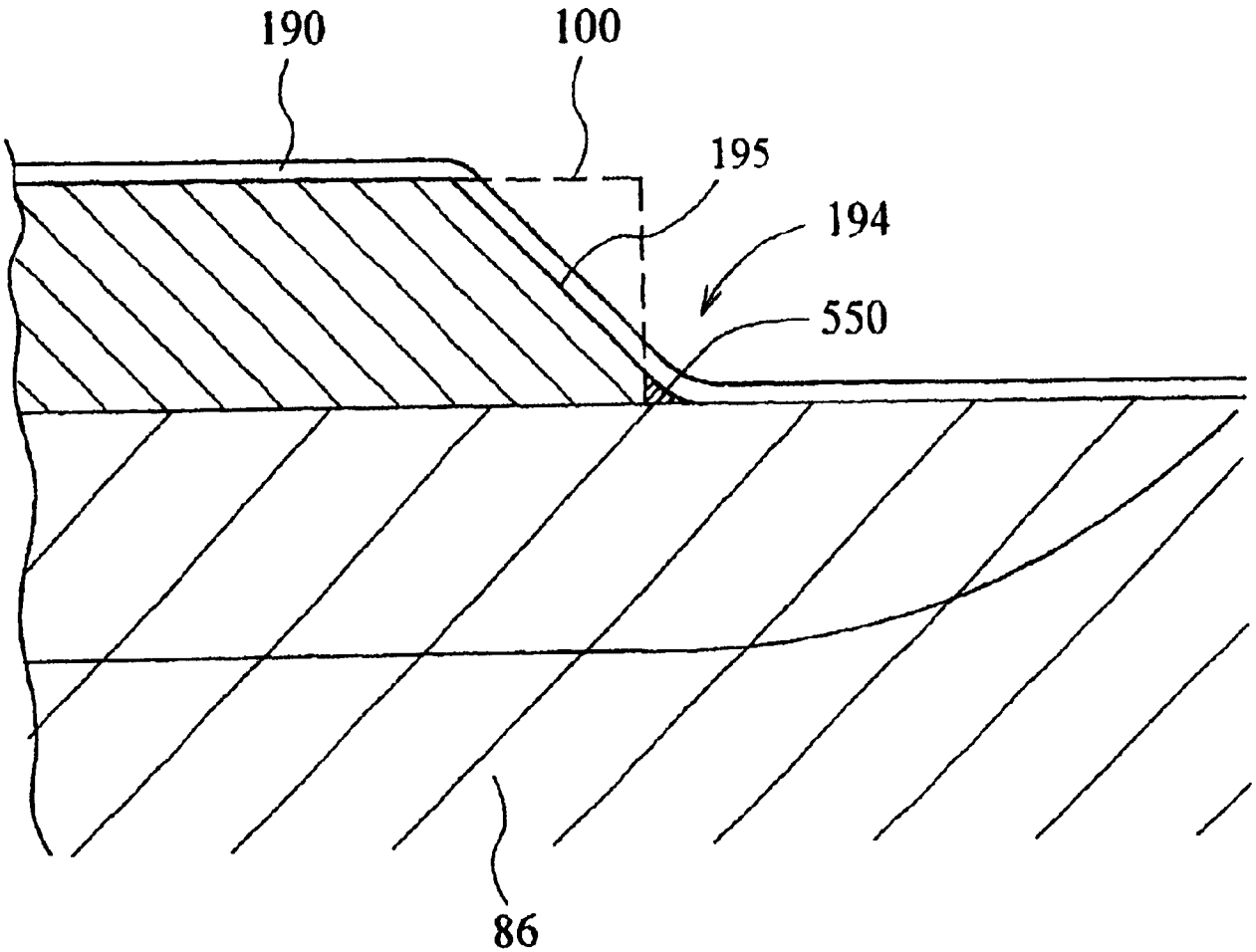
FIG. 14 is a detail view of the area denoted by reference Figure 194 in FIG. 6(*b*)

A further feature is illustrated in FIG. 14, which is a detail view of the area denoted by reference Figure 194 in FIG. 6(*b*). The fillet 550 created when adhesive is squeezed out during creating of the joint between the piezoelectric layer 100 and substrate 86 is advantageously retained when chamfer 195 is formed on the end surface of the layer as described above. This adhesive fillet is subsequently exposed when the assembly is subjected to a pre-plating cleaning step (e.g. plasma etching) and provides a good key for the electrode material 190 in an area that would otherwise be vulnerable to plating faults.

Figure 15:
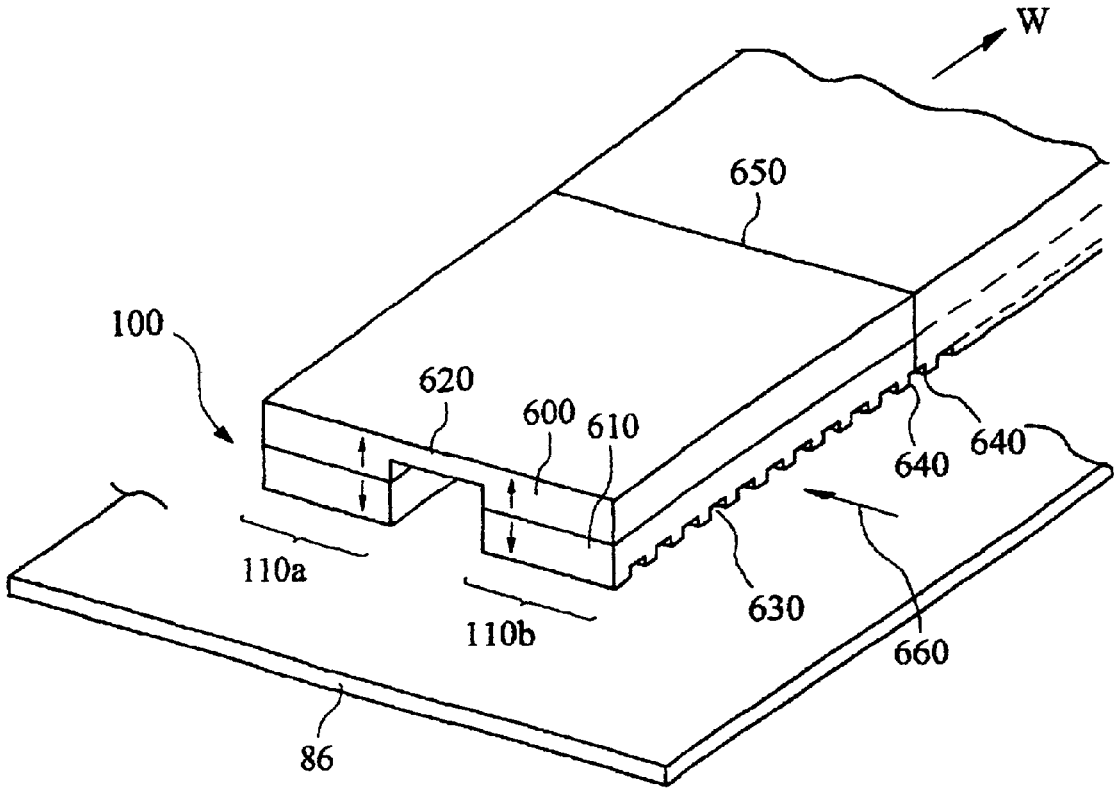
FIG. 15 is a perspective view showing a step in the manufacture of a printhead of the kind shown in FIG. 11.

A further modification is explained with reference to FIG. 15. As already explained above, the piezoelectric material for the channel walls is incorporated in a layer 100 made up of two strips 110*a*, 110*b* each butted with other strips in the direction W necessary for a wide array of channels. Depending on whether the actuator is of the "cantilever" or "chevron" type, the piezoelectric layer will be polarised in one or two (opposed) directions and, in the latter case, may be formed from two oppositely-polarised sheets laminated together as shown at 600 and 610 in FIG. 15. To facilitate relative positioning, strips 110*a*, 110*b* are connected together by a bridge piece 620 that is removed in the chamfering step that takes place once strip 100 and substrate 86 have been bonded together using adhesive.

Figure 16:
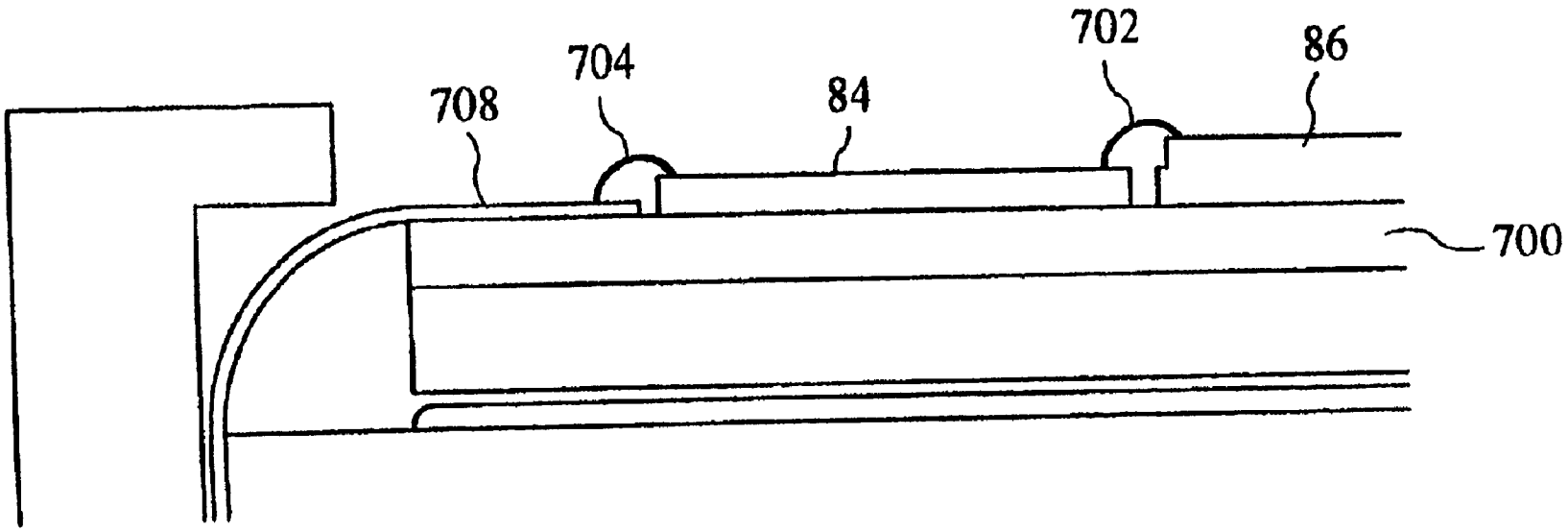
FIG. 16 is a sectional view illustrating a further modification.

A still further modification is illustrated in FIG. 16. Here, the integrated circuit 84 is not mounted on the substrate 86 but on an auxiliary substrate 700, which may be single or multi-layer. The substrate 86 is appropriately bonded to the auxiliary substrate 700 and wire bonds 702 connect the conductive tracks on the substrate 86 with the pins of the integrated circuit. Further wire bonds 704 then interconnect the integrated circuit with pads 708 on the auxiliary substrate 700.

The present invention has been explained with regard to the figures contained herein but is in no way restricted to such embodiments. In particular, the present techniques are applicable to printheads of varying width and resolution, pagewide double-row being merely one of many suitable configurations. Printheads having more than two rows, for example, are easily realised using tracks used in multiple layers as well-known elsewhere in the electronics industry.

All documents, particularly patent applications, referred to are incorporated in the present application by reference.

What is claimed is:

1. A method of manufacturing a component of a droplet deposition apparatus, the component comprising a body and a base, the body comprising piezoelectric material having a plurality of channels each with a channel surface, the body being attached to a surface of the base which is free of substantial discontinuities; the method comprising the steps of attaching the body to said surface of the base such that a portion of said surface of the base remains uncovered by the body; and depositing a layer of conductive material so as to extend continuously over said portion of said surface of the base and at least one of said channel surfaces to provide an electrode on each channel surface and a conductive track on said surface of the base, the conductive track being integrally connected to the electrode.

2. A method according to claim 1, comprising the further step of removing regions of the layer of conductive material to define electrodes for different channels, which electrodes are electrically isolated one from another.

3. A method according to claim 2, comprising the further step of removing regions of the layer of conductive material to define conductive tracks which are electrically isolated one from another.

4. A method according to claim 3, comprising the step of removing said regions of the layer of conductive material through local vaporization of conductive material.

5. A method according to claim 4, comprising the step of vaporizing said conductive material through the use of a laser beam.

6. A method according to claim 2, wherein a land is defined between neighboring channels on the body and the method comprising the step of removing a strip of conductive material from the land.

7. A method according to claim 1, comprising the further step of removing regions of the layer of conductive material to define conductive tracks which are electrically isolated one from another.

8. A method according to claim 7, comprising the step of removing said regions of the layer of conductive material through local vaporization of conductive material.

9. A method according to claim 8, comprising the step of vaporizing said conductive material through the use of a laser beam.

10. A method according to claim 1, comprising the step of depositing said layer in a pattern to define electrodes for different channels, which electrodes are electrically isolated one from another.

11. A method according to claim 10, comprising the step of achieving patterning of the deposited conductive layer through the use of masking.

12. A method according to claim 1, comprising the step of depositing said layer in a pattern defining a plurality of said conductive tracks which are electrically isolated one from another.

13. A method according to claim 1, comprising the step of attaching the body to the base prior to formulation of the channels in the body.

14. A method according to claim 13, comprising the step of forming the channels by removing regions of the body.

15. A method according to claim 14, wherein the step of removing regions of the body defines discrete walls of piezoelectric material, separated one from each other.

16. A method according to claim 14, wherein the step of removing regions of the body also removes regions of the base.

17. A method according to claim 1, comprising the step of chamfering the body adjacent the base to provide regions of the deposited layer of conductive material which overlie the body and the base respectively and which meet at an obtuse angle.

18. A method according to claim 1, comprising the step of attaching the body to the base through adhesive, there being defined between the body and the base a fillet of said adhesive which serves as a key for the deposited layer of conductive material.

19. A method of manufacturing a component of a droplet deposition apparatus comprising the steps of:

providing a base having a planar top surface;

applying a piezoelectric body overlying the base and leaving a portion of the top surface of the base uncovered by the body;

forming a channel in the body and the base, the channel having a pair of opposed channel sidewalls oriented generally perpendicular to the top surface of the base, a flat surface of the uncovered portion remaining after forming the channel;

depositing a layer of conductive material over the uncovered portion to form a conductive track, the layer of conductive material also covering at least a portion of at least one of the channel sidewalls to form an electrode, the conductive material extending continuously from the electrode to the conductive track.

* * * * *